US006813853B1

(12) United States Patent
Tucker

(10) Patent No.: US 6,813,853 B1
(45) **Date of Patent: *Nov. 9, 2004**

(54) SECTIONAL DISPLAY SYSTEM

(75) Inventor: Wayne R. Tucker, Volga, SD (US)

(73) Assignee: Daktronics, Inc., Brookings, SD (US)

( * ) Notice: Subject to any disclaimer, the term of this patent is extended or adjusted under 35 U.S.C. 154(b) by 75 days.

This patent is subject to a terminal disclaimer.

(21) Appl. No.: 09/992,199

(22) Filed: Feb. 25, 2002

(51) Int. Cl.[7] ..... G09F 9/00

(52) U.S. Cl. ..... 40/448; 40/452; 40/573; 40/605; 340/815.45; 340/815.53; 345/55; 345/59; 345/82

(58) Field of Search ..... 40/448, 452, 573, 40/605; 340/815.45, 815.53; 345/55, 59, 82, 87

(56) References Cited

U.S. PATENT DOCUMENTS 1,654,255 A * 12/1927 Hendry ..... 40/545
3,291,975 A * 12/1966 McCullough et al. ..... 362/235
4,006,476 A * 2/1977 Romney ..... 340/815.62
4,287,555 A * 9/1981 Stilling ..... 362/225
5,020,253 A * 6/1991 Lie et al. ..... 40/576
5,184,116 A * 2/1993 Daugherty et al. ..... 345/109
5,216,411 A * 6/1993 Ashitomi et al. ..... 345/168
6,314,669 B1 * 11/2001 Tucker ..... 40/448
6,741,222 B1 * 5/2004 Tucker ..... 345/1.1

* cited by examiner

*Primary Examiner*—William L. Miller
(74) *Attorney, Agent, or Firm*—Hugh D. Jaeger

(57) ABSTRACT

Electronic alpha-numeric or symbol sectional display system featuring readily accessible access to internally located modular display and other components for quick changeout of modular and other components. Display panels, which are modular, are readily and quickly secured in stackable enclosure cabinets by the use of ¼ turn or other quick fastening hardware. Other changeout friendly hardware is incorporated within to promote economy of manufacturing and changeout functions. Viewability of alpha-numeric or other symbol information is preserved and enhanced by the use of small panel fine mesh screens which maintain planar attributes and which are located at the front of each modular display panel residing in close proximity to the LED character block displays.

34 Claims, 13 Drawing Sheets

SECTIONAL DISPLAY SYSTEM

CROSS REFERENCES TO CO-PENDING APPLICATIONS

None.

BACKGROUND OF THE INVENTION

1. Field of the Invention

The present invention pertains to lighting displays or message boards and, more particularly, relates to a sectional electronic alpha-numeric light display system which incorporates modular assemblies which is easily and readily installed and maintained by the provision of quick and easy access to the internally located components.

2. Description of the Prior Art

Prior art sign displays were not always designed from the standpoint of easily and readily accomplished installation or maintenance and, at best, ready access was often considered late in the execution of the design. Access often was provided either from the back side or the front side of the sign and then required that a generous number of fasteners, such as screws, nuts, bolts, clips or the like be laboriously removed for separation of layered components and to disassemble the sign for access to the other internal components such as illuminating devices such as incandescent lights or LED's, circuit boards, power supplies or other such devices. Often displays of larger sizes required that entire large, unwieldy and expansive surrounding frontal framework members be removed to gain access to a small portion of the display, thus requiring the use of extra personnel. Large frontally located screen mesh in front of LED character blocks often proved difficult to properly stretch, to manage, to place and to orient without screen mesh distortion, thus hampering visual acuity. Excessive bulkiness also created a symmetry problem between adjacent LED character block panel assemblies. Addition of adjacent or stacked assemblies often proved difficult with respect to maintaining proper spacing between LED character block panel assemblies, wherein the distance from LED character blocks provided between LED character blocks in each individual LED character block panel assembly was not consistent when comparing LED character block to LED character block spacing of LED character blocks from one LED character block panel to other adjacent or stacked LED character block panel assemblies.

Clearly what is needed is a sectional sign display system which incorporates manageability with respect to installing component size, component symmetry and spacing, modularity and closely aligned LED character block components, which combines with quick and ready accessibility to the layered or other component members for the purpose of quick changeout or other maintenance such as is offered by the present invention, as now described.

SUMMARY OF THE INVENTION

The general purpose of the present invention is a sectional electronic alpha-numeric light modular display system, also called the sectional display system, which is constructed of major components incorporating, in general, building blocks of modules, including one or more stackable enclosure cabinets and a plurality of display panels, which are modular, fastened to and residing in the enclosure cabinet(s). Each modular display panel includes side by side, or in the alternative, singular display module/nested frame assemblies, joined by upper and lower framework channels. Each modular display panel has one or more display circuit board module/nested frame assemblies, each having a plurality of LED character blocks, a driver circuit board, sometimes incorporated in a display circuit board module, and inner and outer configured nesting frames surrounding the edges of the display circuit board module. The nesting inner and outer frames capture a fine mesh screen or other alternative filtering materials. The captured fine mesh screen aligns closely to the LED character block to provide best visual acuity and to prevent parallax distortion. Each modular display panel aligns to opposing inner and outer vertically aligned brackets located in the enclosure cabinet and is secured thereto by mating resident quick fastening hardware on the rearward edge of each display panel and on the inner and outer brackets. Access holes are provided through the display panel(s) for actuation of the quick fastening hardware for removal or installation of each modular display panel. The enclosure cabinet also houses a controller card, power supplies and other components. A method and structure is also provided for stacking of or placing side by side of multiple unit sectional displays constructed in accordance with the present invention.

According to one or more embodiments of the present invention, there is provided a sectional alpha-numeric or symbol light display system including an enclosure cabinet and one or more modular display panels secured within the enclosure cabinet. Each modular display panel includes an inner and an outer frame, a fine mesh screen or other filtering media closely engaged between the inner and outer frames, display circuit boards, which are modular, having LED character blocks located rearwardly of the fine mesh screen, a driver circuit board, upper and lower framework channels at the rear of the display circuit boards, and quick fastening hardware located and residing on the rearward portion of the upper and lower framework channels. The enclosure cabinet, which receives and accommodates each modular display panel, includes one or more inner and outer opposing and vertically oriented brackets having quick fastening hardware for accommodation of and for securing to the quick fastening hardware of the modular display panel.

One significant aspect and feature of the present invention is a sectional alpha-numeric or symbol light display system having quick change and installation capabilities.

Yet another significant aspect and feature of the present invention is a sectional alpha-numeric or symbol light display system which is readily accessible by common tools from the front.

Still another significant aspect and feature of the present invention is a sectional alpha-numeric or symbol light display system requiring a minimum of tools for accessing the interior of the display system.

A further significant aspect and feature of the present invention is a sectional alpha-numeric or symbol light display system incorporating quick fastening hardware for installation or removal of a modular display panel to or from the surrounding enclosure cabinet.

A still further significant aspect and feature of the present invention is a sectional alpha-numeric or symbol light display system in which the nucleus of components can be removed from the front of an enclosure cabinet.

Yet another significant aspect and feature of the present invention is component manageability with respect to size provided by incorporation of sectional, panel, and modular construction.

Yet another significant aspect and feature of the present invention is the incorporation of fine mesh screen or other filtering media utilized as small area manageable units.

Yet another significant aspect and feature of the present invention is close placement of the fine mesh screen or filtering media to LED character blocks to preserve visual acuity and to prevent or minimize parallax distortion.

Yet another significant aspect and feature of the present invention is the incorporation of nested outer frames and inner frames which capture a fine mesh screen or filtering media therebetween.

Still another significant aspect and feature of the present invention is the use of one or more horizontal aligned Z-shaped mounting bars and vertically aligned brackets on the rearward area of the sectional display system. Disassembly of the sectional display system is not required to attach the vertically aligned brackets to the rearward area of the sectional display system or to mount the sectional displays to a wall or suitable mounting surface.

Another significant aspect and feature of the present invention allows simple and straightforward ease of installation of the sectional display system where disassembly of components is not required.

Still another significant aspect and feature of the present invention is the ability to provide power to and to provide signal interconnecting between multiply-placed or multiply-stacked sectional display systems without disassembly of sectional displays during the mounting procedure.

Another significant aspect and feature of the present invention is the incorporation of internally threaded fasteners secured to component members which minimize construction and maintenance functions with respect to time, materials and cost.

Another significant aspect and feature of the present invention is the arraying of modular display panels and/or the arraying of sectional display systems to maintain center-to-center distance of LED character blocks consistently throughout the entire height and length of adjacent or stacked modular display panels and/or adjacent or stacked sectional display systems to provide a seamless appearance.

As shown in an alternative embodiment, flush mounted studs replace machine screws and extend in rigid fashion to provide for simpler overall ease of assembly and to present a more aesthetically pleasing display module outer frame.

Having thus set forth distinguishing traits of the present invention, it is one object of the present invention to provide a sectional alpha-numeric or symbol light display system having easily accessible installation and quick change capabilities.

Other objects of the present invention are now set forth.

Other aspects of the quick change display system are incorporated into already required parts, and thus parasitic parts are minimized. The fastening system is captive. That is, it is secured to each modular display panel or other components at all times and will not fall from a modular display panel when the panel is removed from the enclosure cabinet for service. Labor of factory assembly is reduced over conventional methods of modular display panel attachment.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
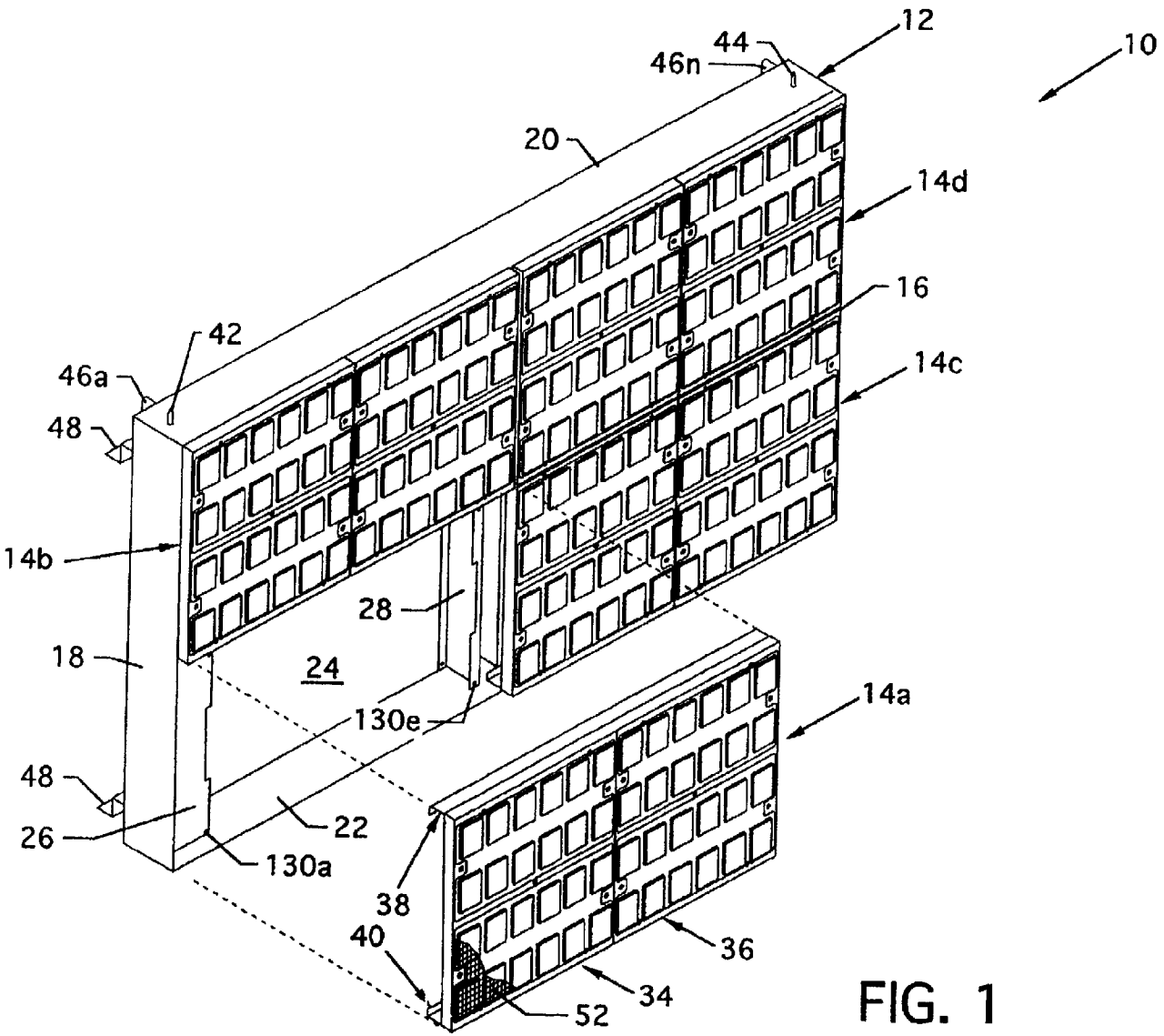
FIG. 1 illustrates an isometric semi-exploded view of a representative sectional electronic alpha-numeric or symbol light display system, known herein as the sectional display system.

FIG. 1 illustrates an isometric and partially exploded view of the electronic alpha-numeric or symbol light display system, known herein as the sectional display system 10. The sectional display system 10 includes an enclosure cabinet 12 into which a plurality of like and similarly configured modular display panels 14*a*, 14*b*, 14*c* and 14*d* mount. The enclosure cabinet 12 includes a right planar side 16, a left planar side 18, a planar top 20, a planar bottom 22 and a planar back 24. Visible in FIG. 1 is a vertically aligned outer bracket 26 and a vertically aligned inner bracket 28, each bracket extending between the planar top 20 and the planar bottom 22 and each being aligned and secured to the planar back 24. The outer bracket 26 and the inner bracket 28 and additional like and similar brackets including a outer bracket 30 and an inner bracket 32 align in a like fashion as just described, and such is illustrated in FIG. 3. Each inner or outer bracket includes a plurality of quick-connect fasteners, as later described in detail. Modular display panel 14*a*, shown displaced from the enclosure cabinet 12, includes a left display module/nested frame assembly 34 and juxtaposed similar right display module/nested frame assembly 36 each secured to an upper framework channel 38 and a lower framework channel 40 in common. When the modular display panel 14*a* is installed into the enclosure cabinet 12, the upper and lower framework channels 38 and 40 position and align perpendicular to the outer bracket 26 and the inner bracket 28 and are suitably secured thereto by quick fastening hardware. Just the structure of the left display module/nested frame assembly 34, which is similar in construction to the right display module/nested frame assembly 36, is described in detail in FIG. 2 and other illustrations for the purpose of brevity and clarity. Also included at the ends of the planar top 20 are vertically oriented alignment pins 42 and 44 extending therefrom which can align to alignment holes in the planar bottom of additional sectional display systems 10 to facilitate stacking of sectional display systems 10. Also included along the planar back 24 are a plurality of vertically aligned brackets 46*a*–46*n* and horizontally aligned and similarly shaped Z-shaped bars 48 upon which the brackets 46*a*–46*n* secure.

Figure 2:
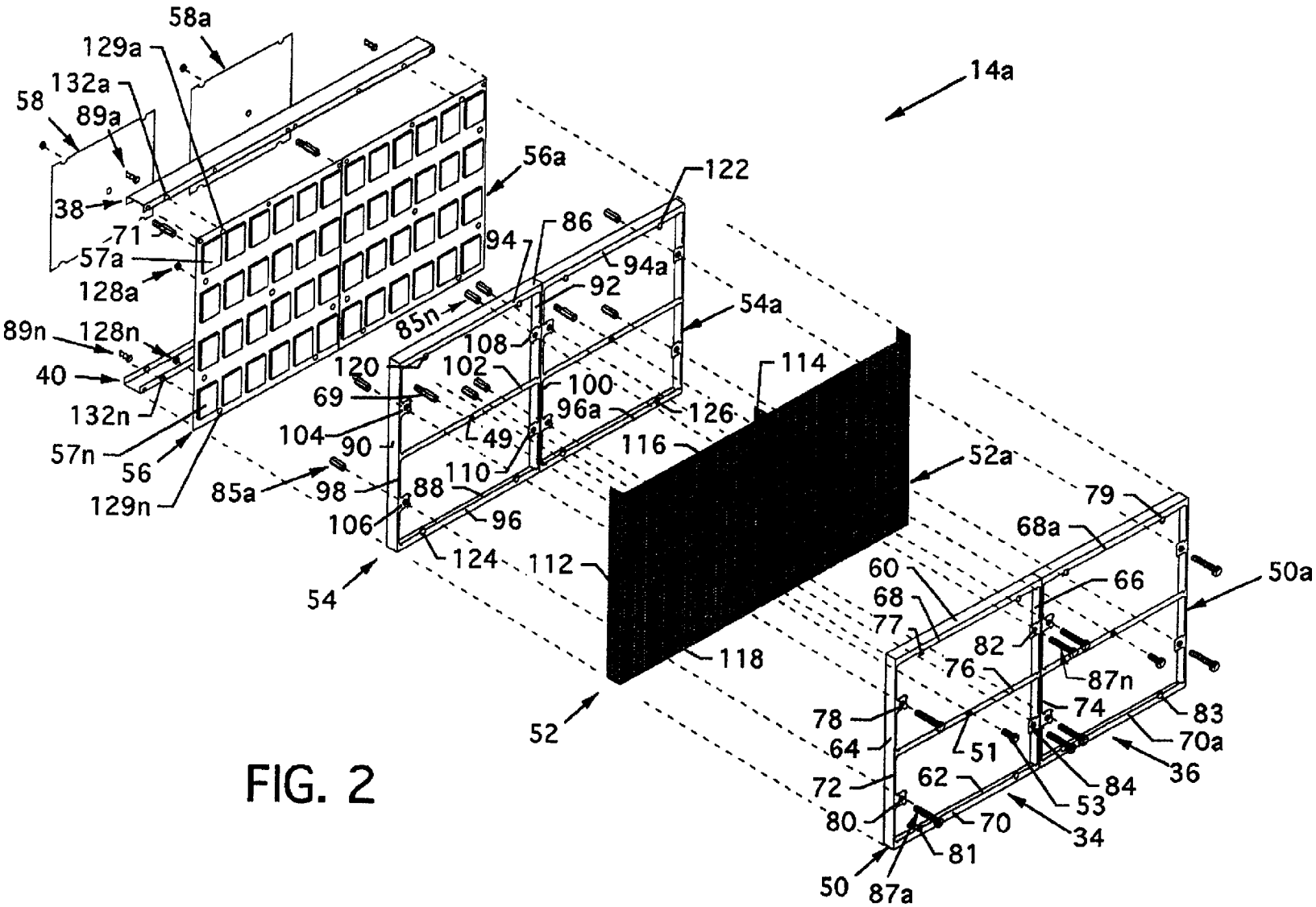
FIG. 2 illustrates an exploded isometric front view of a representative modular display panel of FIG. 1.

FIG. 2 illustrates an exploded view of the modular display panel 14*a*, where all numerals correspond to those previously or otherwise described. Modular display panel 14*a* includes similar side by side and mutually joined left and right display module/nested frame assemblies 34 and 36 of which the left display module/nested frame assembly 34 is now described. The most readily visible components of the left display module/nested frame assembly 34 include an outer frame 50, also illustrated in FIG. 2A, a fine mesh screen 52, an inner frame 54, also illustrated in FIG. 2B, a display circuit board module 56 which includes a plurality of LED character blocks 57*a*–57*n*, and a driver circuit board 58 which, alternatively, can be incorporated into the display circuit board module 56. The right display module/nested frame assembly 36 is composed of like and similar components as that shown in the left display module/nested frame assembly 34 including outer frame 50*a*, a fine mesh screen 52*a*, an inner frame 54*a*, a display circuit board module 56*a*, and a driver circuit board 58*a*. Other components in this figure and following figures may also be referred to utilizing an "a" suffix to designate like and corresponding component parts. The upper and lower framework channels 38 and 40 align across and suitably secure to the upper regions and the lower regions of the display circuit board module 56 and also to the adjacent display circuit board module 56*a* of the right display module/nested frame assembly 36 to secure together the components of the left and right display module/nested frame assemblies 34 and 36, thereby forming the modular display panel 14*a*. Inner frame 54 and outer frame 50 are similarly shaped but differently dimensioned structures. The inner frame 54 is constructed to nest and fit closely within the general confines of the outer frame 50 and at the same time to capture the fine mesh screen 52, or alternative filtering media, between the structure of the inner and outer frames 54 and 50, respectively.

Figure 2A:
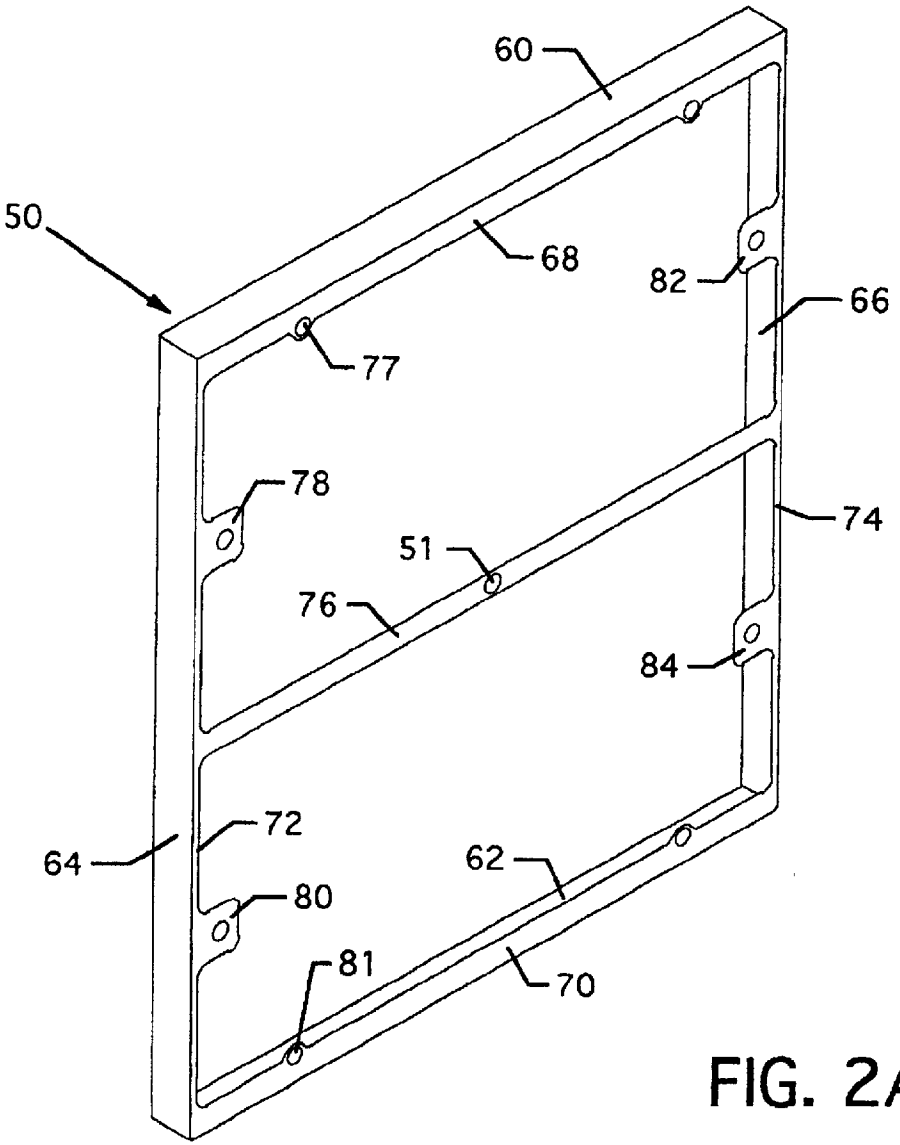
FIG. 2A illustrates an isometric view of the outer frame.
Figure 3:
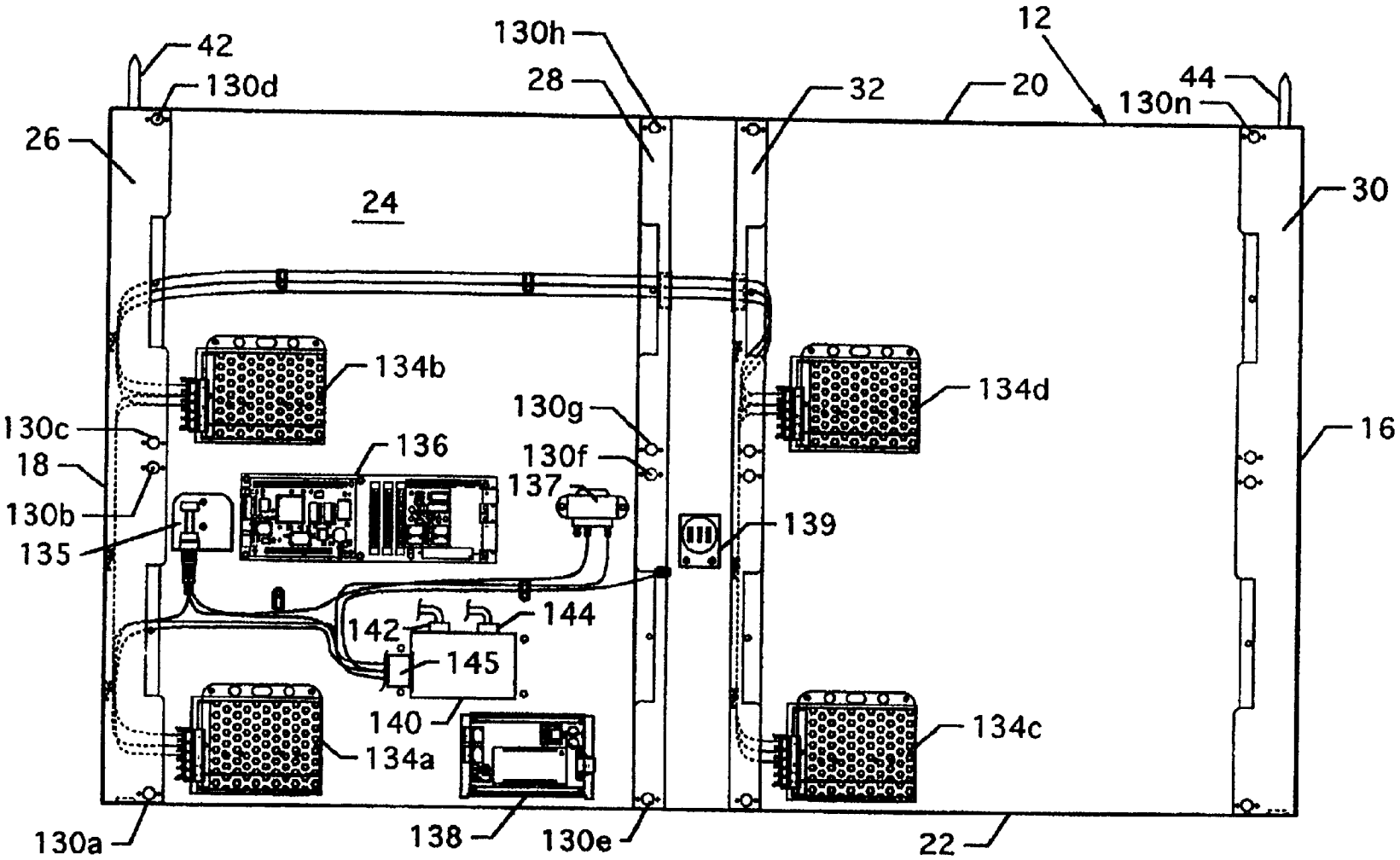
FIG. 3 illustrates a front view of the enclosure cabinet of FIG. 1.

The outer frame 50, a one-piece unit, as also shown in FIG. 2A, includes a top planar panel 60, an opposing bottom planar panel 62, a left planar panel 64, a right planar panel 66, an upper planar frontal panel 68 extending at a right angle downwardly from the top planar panel 60, a lower planar frontal panel 70 extending upwardly at a right angle from the bottom planar panel 62, a left planar frontal panel 72 extending inwardly at a right angle from the left planar panel 64, a right planar frontal panel 74 extending inwardly at a right angle from the right planar panel 66, a horizontally aligned central planar frontal panel 76 located and extending between the left planar frontal panel 72 and the right planar frontal panel 74, an upper planar tab 78 and a lower planar tab 80 extending inwardly from the left planar frontal panel 72, and an upper planar tab 82 and a lower planar tab 84 extending inwardly from the right planar frontal panel 74. Each planar tab 78, 80, 82 and 84 and the central planar frontal panel 76 includes a body hole for securing of the outer frame 50 to the inner frame 54 by a plurality of machine screws 87*a*–87*n* which engage a plurality of internally threaded spacers 85*a*–85*n* on the rearward side of the inner frame 54 for the purpose of securing the fine mesh screen 52 therein. Access hole 77 is located in the upper planar frontal panel 68 and access hole 81 is located in the lower planar frontal panel 70 and access hole 79 and access hole 83 are located in the corresponding panels 68*a* and 70*a* of the outer frame 50*a* (of the right display module/nested frame assembly 36) for actuation (through additional component layers) of a plurality of quick fastening hardware ¼ turn male fasteners 89*a*–89*n* located in the upper and lower framework channels 38 and 40, as later described in detail. Operation of the quick fastening hardware ¼ turn male fasteners 89*a*–89*n* in the appropriate rotational manner through the access holes 77, 79, 81 and 83 allows the left and right display module/nested frame assemblies 34 and 36, which together form the modular display panel 14*a*, to be installed or removed as a single unit.

Figure 2B:
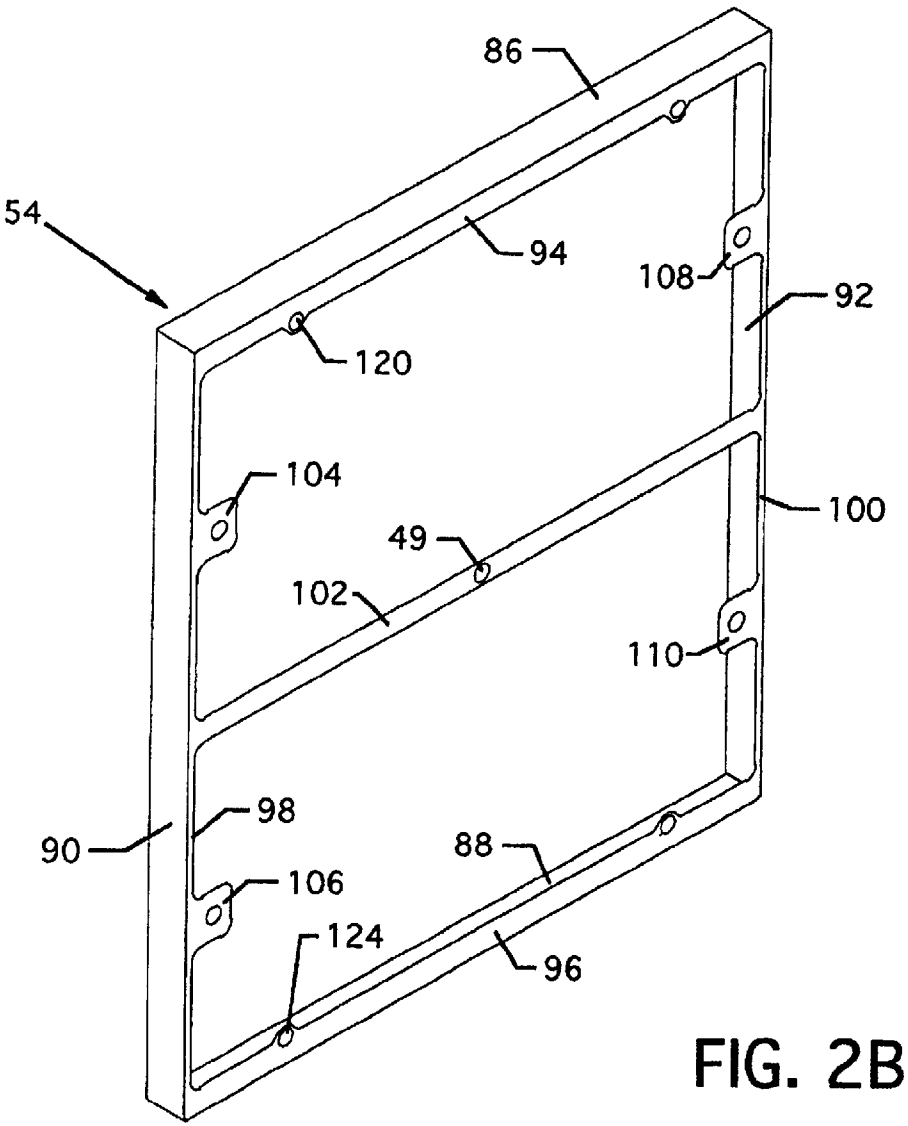
FIG. 2B illustrates an isometric view of the inner frame.

The inner frame 54, as also shown in FIG. 2B, a one-piece unit, is sized slightly smaller than the outer frame 50, and the planar frontal panels of the inner frame 54 are configured dimensionally to replicate in alignmental size the corresponding planar frontal panels of the outer frame 50 to which the planar frontal panels of the inner frame 54 align in order to provide best frontal alignment for capture of the fine mesh screen 52. The inner frame 54 includes a top planar panel 86, an opposing bottom planar panel 88, a left planar panel 90, a right planar panel 92, an upper planar frontal panel 94 extending at a right angle downwardly from the top planar panel 86, a lower planar frontal panel 96 extending upwardly at a right angle from the bottom planar panel 88, a left planar frontal panel 98 extending inwardly at a right angle from the left planar panel 90, a right planar frontal panel 100 extending inwardly at a right angle from the right planar panel 92, a horizontally aligned central planar frontal panel 102 located and extending between the left planar frontal panel 98 and the right planar frontal panel 100, an upper planar tab 104 and a lower planar tab 106 extending inwardly from the left planar frontal panel 98, and an upper planar tab 108 and a lower planar tab 110 extending inwardly from the right planar frontal panel 100. Each planar tab 104, 106, 108 and 110 and the central planar frontal panel 102 includes a body hole for securing of the outer frame 50 to the inner frame 54 by the plurality of machine screws 87*a*–87*n* which engage the plurality of internally threaded spacers 85*a*–85*n* on the rearward side of the frame 54 for the purpose of securing the fine mesh screen 52 therein. Access holes 120 and 122 are located in the upper planar frontal panels 94 and 94*a* and access holes 124 and 126 are located in the lower planar frontal panels 96 and 96*a* for actuation (through additional component layers) of a plurality of quick fastening hardware ¼ turn male fasteners 89*a*–89*n* located in the upper and lower framework channels 38 and 40, as later described in detail.

The fine mesh screen 52, or alternate filtering media, may be preformed to provide a left planar tab 112 and a right planar tab 114 and also includes a top edge 116 and a bottom edge 118. The fine mesh screen 52 is captured between the structure of the inner and outer frames 54 and 50, respectively, and presents a smooth fine mesh planar area for optimal and undistorted viewing of the LED character blocks 57*a*–57*n* located immediately to the rearward of the fine mesh screen 52. The left planar tab 112 of the fine mesh screen 52 is captured in frictional engagement between the left planar panel 64 of the outer frame 50 and the left planar panel 90 of the inner frame 54, and, in a similar fashion, the right planar tab 114 of the fine mesh screen 52 is captured in frictional engagement between the right planar panel 66 of the outer frame 50 and the right planar panel 92 of the inner frame 54. To aid in retaining a flat and planar fine mesh screen (52) surface, the top edge 116 is captured and held by the outer frame upper planar frontal panel 68 and the inner frame upper planar frontal panel 94 and the bottom edge 118 is captured and held by the outer frame lower planar frontal panel 70 and the inner frame lower planar frontal panel 96. The plurality of machine screws 87*a*–87*n* align the outer frame 50, expressly, through the body holes of the upper planar tabs 78 and 82, the lower planar tabs 80 and 84; through appropriately located (not shown) holes in the screen 52; through the inner frame 54, expressly, through the body holes of the upper planar tabs 104 and 108, the lower planar tabs 106 and 110; and then into a plurality of internally threaded spacers 85*a*–85*n*. The machine screws 87*a*–87*n* are tightened in the spacers 85*a*–85*n* to draw the inner frame 54 and the outer frame 50 towards each other in nesting and intimate engagement to capture, tension and contain the fine mesh screen 52 therein. Access holes 77, 79, 81 and 83 in the upper planar frontal panels 68 and 68*a* and the lower planar frontal panels 70 and 70*a*, respectively, of the outer frames 50 and 50*a*, respectively, are in alignment through appropriately located (not shown) holes in the screens 52 and 52*a*, respectively, with access holes 120, 122, 124 and 126 in the upper and lower planar frontal panels 94 and 94*a* and 96 and 96*a*, respectively, with a plurality of holes 129*a*–129*n* in the display circuit board modules 56 and 56*a*, respectively, with a plurality of holes 132*a*–132*n* in the upper and lower framework channels 38 and 40, respectively, and with a plurality of ¼ turn male fasteners 89*a*–89*n* secured, for the purpose of rotation, in the rearward portion of the upper and lower framework channels 38 and 40.

FIG. 2A illustrates an isometric view of the outer frame 50, where all numerals correspond to those previously or otherwise described.

FIG. 2B illustrates an isometric view of the inner frame 54, where all numerals correspond to those previously or otherwise described.

FIG. 3 illustrates a front view of the enclosure cabinet 12 with the modular display panels 14*a*, 14*b*, 14*c* and 14*d* removed, where all numerals correspond to those previously or otherwise described. Illustrated in particular are symmetrically opposed outer brackets 26 and 30, symmetrically opposed inner brackets 28 and 32, and the plurality of ¼ turn female fastener receptacles 130*a*–130*n* residing thereupon. A plurality of power supplies 134*a*–134*d*, intended for use with modular display panels 14*a*–14*d*, a controller card 136, an optional modem 138, an optional fuse/fuse holder 135, an optional transformer 137, an optional buzzer 139, and other components are secured to the planar back 24 of the enclosure cabinet 12. An access termination panel 140 is also located on the planar back 24 for access to signal input and output jacks 142 and 144 and to a power input jack 145. The signal input and output jacks 142 and 144 facilitate connection of multiple sectional display systems 10 where a plurality of sectional display systems are stacked or placed side by side for large display use.

Figure 4:
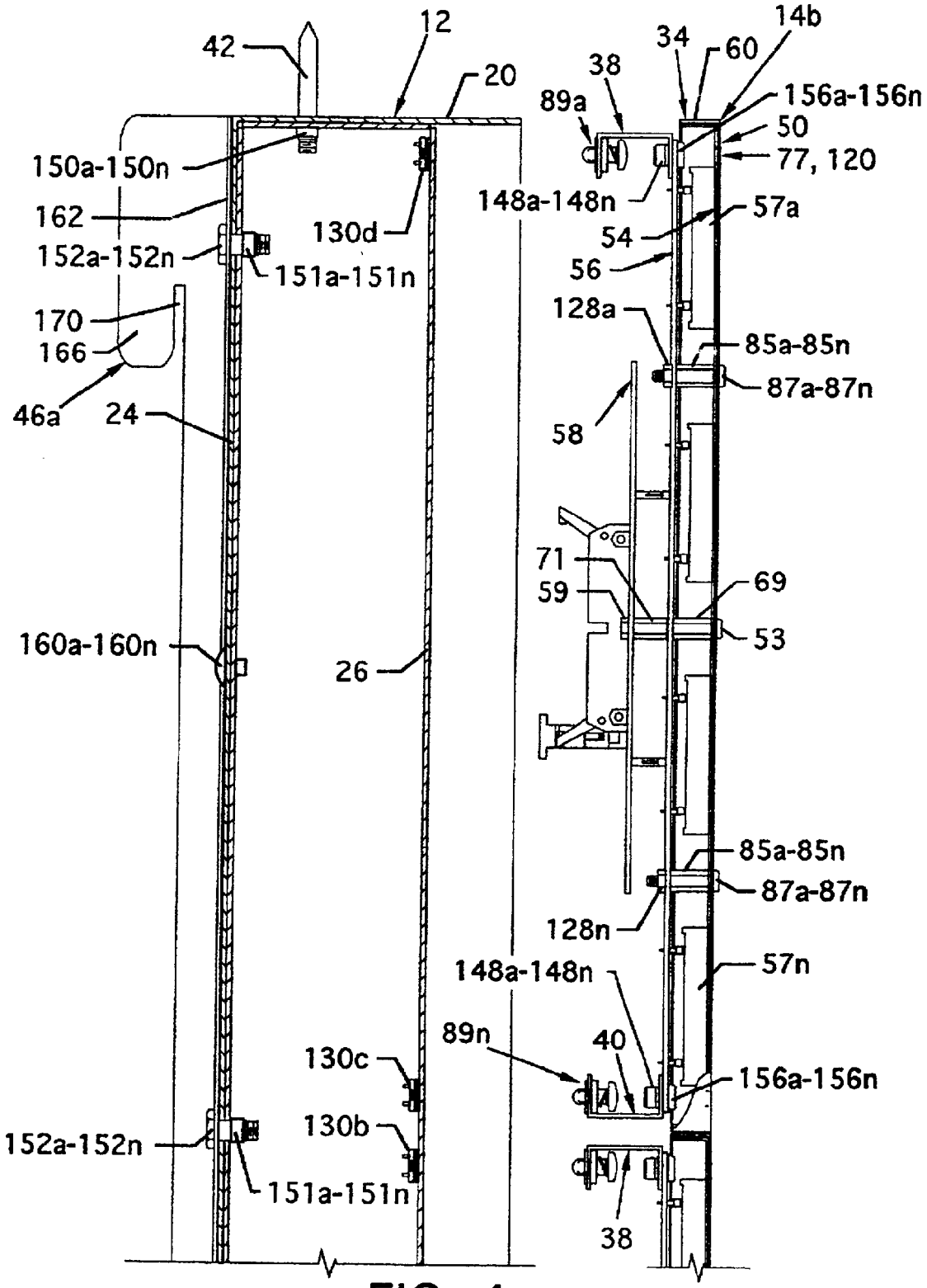
FIG. 4 illustrates an exploded side view in cutaway and partial cross-section of the sectional display system.
Figure 7:
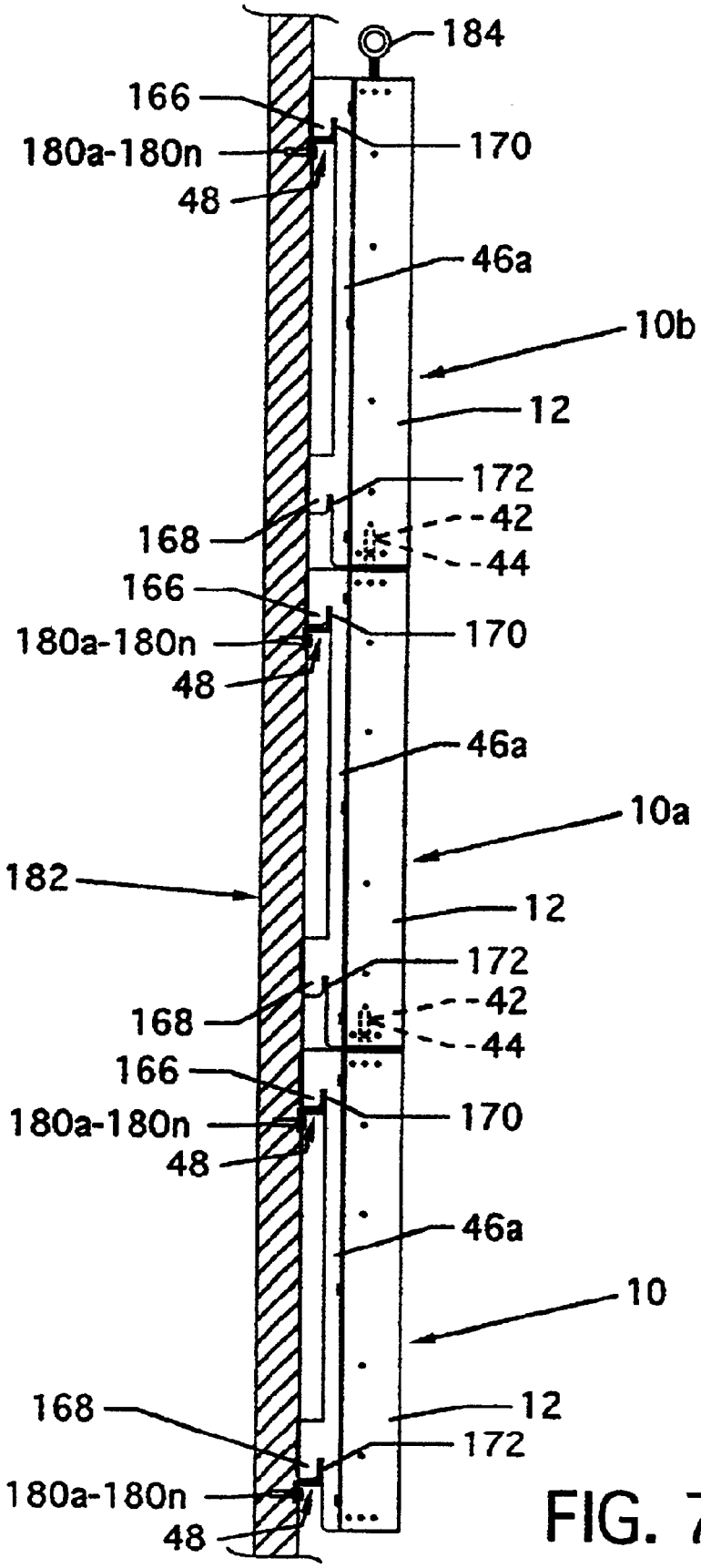
FIG. 7 illustrates the method of stacking of the sectional display system with other identical or similarly constructed or otherwise dimensioned sectional display systems.

FIG. 4 illustrates a side view of modular display panel 14*b*, similar in construction to the previously described modular display panel 14*a*, removed from but aligned to the upper region of the enclosure cabinet 12, where all numerals correspond to those previously or otherwise described. Illustrated in particular is the placement and alignment of the components of the modular display panel 14*b* with respect to itself and to the components of the enclosure cabinet 12. As previously described, the plurality of machine screws 87*a*–87*n* pass through the planar tabs of the outer frame 50, the fine mesh screen 52, the inner frame 54 and into the plurality of internally threaded spacers 85*a*–85*n*. Machine screws 87*a*–87*n* extend through and beyond the internally threaded spacers 85*a*–85*n* to serve as mounting posts for the display circuit board module 56 which is secured thereto by a plurality of nuts 128*a*–128*n*. In a somewhat similar fashion, a machine screw 53, of short length, passes through a hole 51 (FIG. 2) of the central planar frontal panel 76 of the outer frame 50, through the fine mesh screen 52, through a hole 49 of the central planar frontal panel 102 of the inner frame 54, and into a male/female threaded spacer 69 that is attached to the display circuit board module 56 to ensure and maintain flatness and planarity in the central region of the fine mesh screen 52. The male/female threaded spacer 69 is attached through the driver circuit board module 56 into another male/female threaded spacer 71 and through the driver circuit board 58 to receive a nut 59 to secure the driver circuit board 58 to the display circuit board module 56. Also secured to the upper framework channel 38 and the lower framework channel 40 are captivated threaded inserts 148*a*–148*n*. A plurality of machine screws 156*a*–156*n* pass through the upper region and the lower region of the display circuit board modules 56 and 56*a* to engage the internally threaded fittings 148*a*–148*n* to secure the upper and lower framework channels 38 and 40 to the display circuit board modules. The upper framework channel 38 and the lower framework channel 40 serve as a structural stiffener for the display circuit board modules 56 and 56*a*, as well as the modular display panels, such as modular display panel 14*b*. Alignment pin 42 threadingly engages one of a plurality of captivated threaded inserts 150*a*–150*n* which are secured to the planar top 20 of the enclosure cabinet 12. Alternatively, ring supports 184, such as shown in FIG. 7, can be utilized in engagement with the captivated threaded inserts 150*a*–150*n* in lieu of the alignment pins 42 and 44 for suspension, such as by a cable or other suitable device, of the sectional display system 10. A bracket 46*a* is shown secured to the planar back 24 of the enclosure cabinet 12 by a plurality of fasteners 152*a*–152*n*, which pass through captivated threaded inserts 151*a*–151*n* which mutually secure the planar back 24 of the enclosure cabinet 12, the bracket 46*a* and the outer bracket 26. A plurality of rivets 160*a*–160*n* pass through the planar back 24 of the enclosure cabinet 12 and secure the outer bracket 26 and other brackets to the planar back 24. The use of internally threaded fittings, such as captivated threaded inserts 148*a*–148*n* and 151*a*–151*n*, simplifies construction and assembly of the invention and also aids in quick and simple installation and for component change-outs without the need for a large number of tools.

Figure 5:
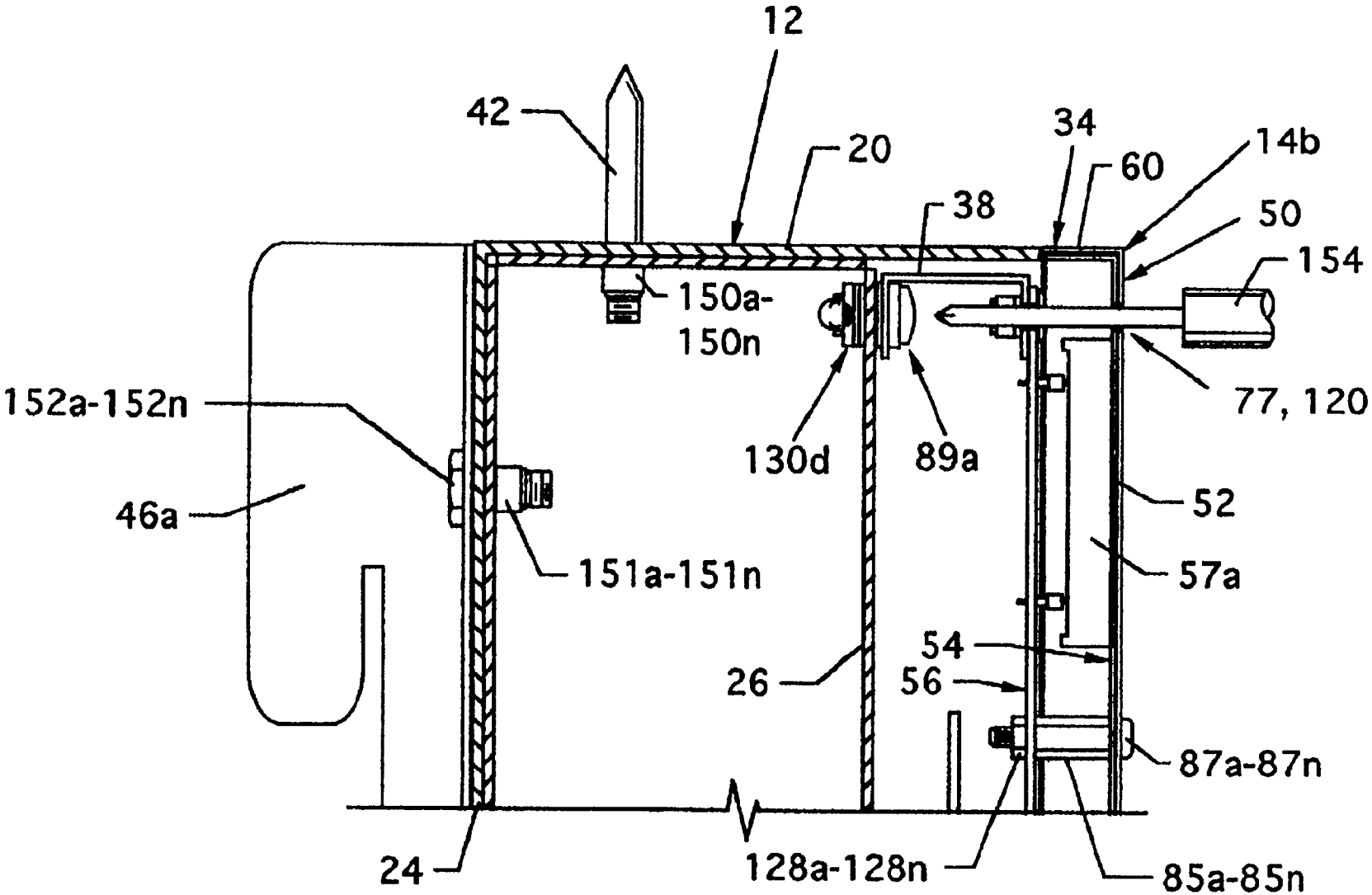
FIG. 5 illustrates a view of the quick fastener hardware.

FIG. 5 illustrates the engagement of the upper framework channel 38 to the outer bracket 26, where all numerals correspond to those previously or otherwise described. With reference to FIG. 5 and FIG. 4 and other figures previously described, the mode of operation is now described in part. The modular display panel 14*b* is brought into engagement within the enclosure cabinet 12, subsequent to cable loom engagement, such that the upper framework channel 38 and the lower framework channel 40 align against the outer bracket 26 and the inner bracket 28. This action aligns the ¼ turn male fastener 89*a* on the upper framework channel 38 to the ¼ turn female fastener receptacle 130*d* located on the outer bracket 26. Subsequently, a screwdriver 154 or other such suitable device is inserted into the co-centered access holes 77 and 120 in the outer frame 50 and the inner frame 54 to engage the ¼ turn male fastener 89*a* and to subsequently position and rotate the shaft thereof to engage the ¼ turn female fastener receptacle 130*d*, thus securing a portion of the modular display panel 14*b* to the enclosure cabinet 12. The same process is used to fasten the remaining ¼ turn male fasteners to the remaining ¼ turn female fastener receptacles. Removal of the modular display panel 14*b* simply incorporates the reversal of the process where a screwdriver 154 or other suitable device in inserted and rotated to disengage the ¼ turn male fasteners from the ¼ turn female fastener receptacles and disconnection of cable looms. Any appropriate quick-connect hardware can be utilized for fastening of the modular display panel 14*a*–14*d* to the enclosure cabinet 12 and shall not be considered to be limiting to the scope of the invention. The first step in disassembly of the invention for component change-out or repair is rapidly accomplished by removal of the modular display panels, such as modular display panel 14*b*, in the manner just described. Further disassembly and removal of the driver circuit board 58 is accomplished simply by removal of nut 59. Removal of the inner frame 54, outer frame 50 and the fine mesh screen 52 as a unit from the display circuit board module 56 is simply accomplished by removal of nuts 128*a*–128*n* and the screw 53; and, further disassembly is facilitated by removal of the upper and lower framework channels 38 and 40 from the display circuit board module 56 by removal of machine screws 156*a*–156*n* subsequent to removal of the inner frame 54, outer frame 50 and the fine mesh screen 52 as a unit.

Figure 6:
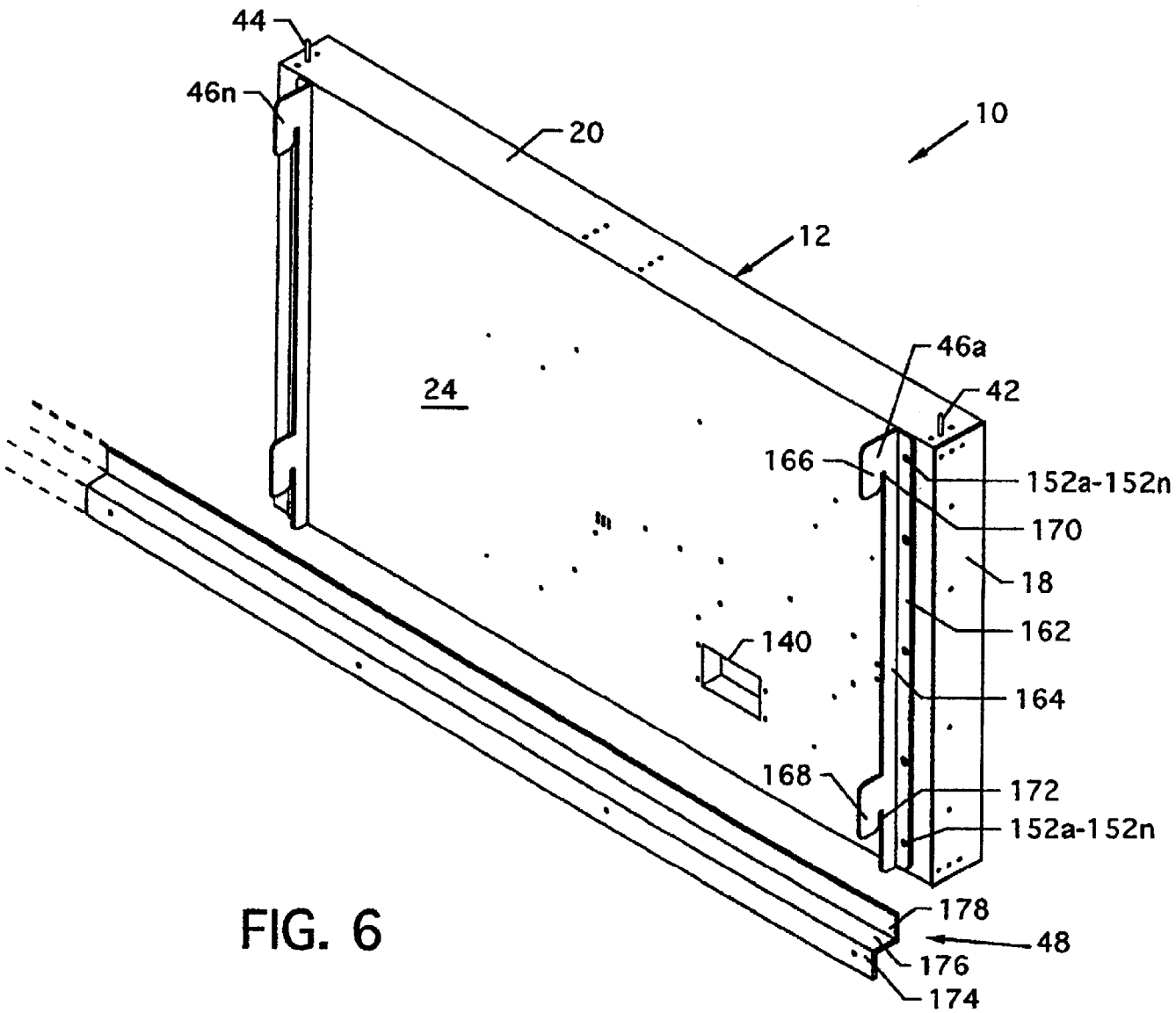
FIG. 6 illustrates an isometric rear view of the sectional display system.

FIG. 6 illustrates an isometric rear view of the sectional display system 10, where all numerals correspond to those previously or otherwise described. Illustrated in particular are the components incorporated for securing the enclosure cabinet 12 containing other components of the sectional display system 10 to a wall or other such surface. The plurality of brackets 46*a*–46*n* are similar in design, and of which can be mirror images, can each include a planar panel 162 which secures to the planar back 24 by a plurality of fasteners 152*a*–152*n*, a configured planar panel 164 extending at a right angle from the planar panel 162, an upper tab 166 and a lower tab 168 extending from the planar panel 162, and an upper slot 170 between the configured planar panel 164 and the upper tab 166, and a lower slot 172 between the configured planar panel 164 and the lower tab 168. Another bracket, called a Z-bar, 48 secures to a wall or other suitable structure to accommodate the brackets 46*a*–46*n*. The Z-bar 48 includes a first vertically oriented planar panel 174, a second horizontally oriented panel 176 extending at a right angle from the first panel 174 and a third vertically oriented panel 178 extending upwardly at a right angle from the second panel 176. Panel 178 can be utilized to engage either or both of the slots 170 and 172 of each bracket 46*a*–46*n*, as shown in FIG. 7. Ease of installation of the sectional display system 10 is simple and straightforward and disassembly of components is not required. The brackets 46*a*–46*n* are simply secured to the enclosure cabinet 12 by fasteners 152*a*–152*n* in engagement with the captivated threaded inserts 151*a*–151*n*, as illustrated in FIG. 4, and then the sectional display system 10, including the brackets 46*a*–46*n* are hung on the mounted Z-bar(s) 48. Power and signal interconnects are quickly made between adjoining sectional display systems by cables between the access termination panels 140.

FIG. 7 illustrates a side view of multiple stacked sectional display systems 10, 10*a* and 10*b*, where all numerals correspond to those previously or otherwise described. A plurality of fasteners 180*a*–180*n* secure a plurality of Z-bars 48 to a wall 182 or other such mounting structure. Two Z-bars 48 are utilized to engage the upper slots 170 and the lower slots 172 to mount the first and lowest sectional display system 10 to the wall 182. A second sectional display system 10*a* is positioned on top of the first sectional display system 10 such that holes correspondingly aligned and located in the planar bottom 22 of the second enclosure cabinet 12 engage the alignment pins 42 and 44 extending from the planar top 20 of the first enclosure 12 to positionally fix the lower region of the second sectional display system 10*a* without the incorporation of an additional and lower Z-bar 48 in the lower slot 172, thus providing for economy of installation with respect to time and materials. An upper Z-bar 48 is incorporated to secure the upper region of the second sectional display system 10*a* wherein the upper slot 170 of the second sectional display system 10*a* is engaged. Additional sectional display systems such as sectional display system 10*b* can be installed in the same manner and fashion as that used for installation of the sectional display system 10*a*. An optional ring 184 is shown extending from the third sectional display system 10*b* such as would be incorporated to suspend a single sectional display system 10.

Figure 8:
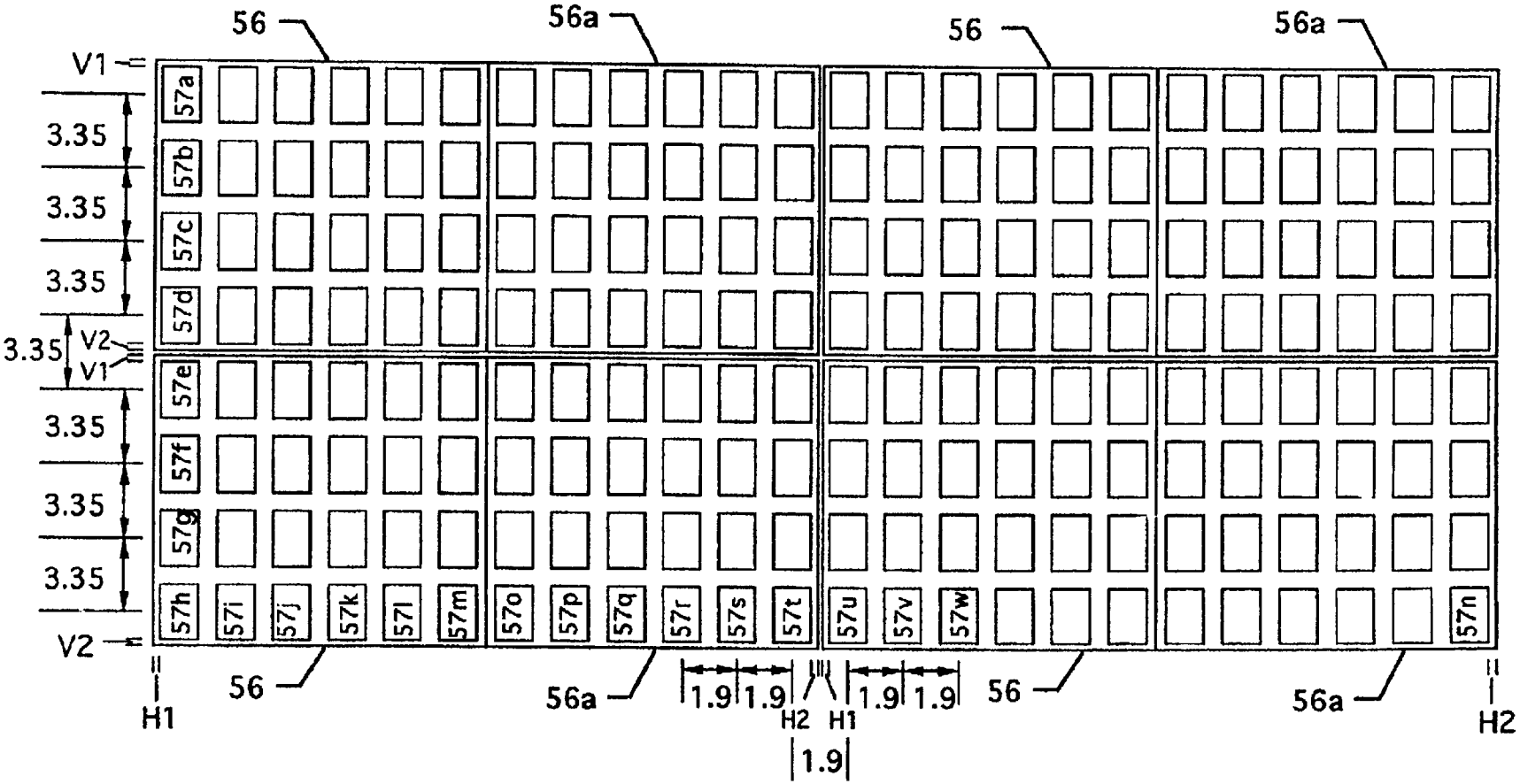
FIG. 8 illustrates the constant center-to-center distance maintained between LED character blocks along and across display circuit board modules.

FIG. 8 illustrates the constant center-to-center distance between LED character blocks 57*a*–57*n* along and across arrayed display circuit board modules 56 and 56*a*, where all numerals correspond to those elements previously or otherwise described. Variously dimensioned LED character blocks 57*a*–57*n* can be incorporated, such as, for purposes of example and illustration, 1.26"h×0.90"w, 2.10"h×1.50"w, and 4.20"h×3.00"w. For purposes of example and illustration, LED character blocks 57*a*–57*n* measuring 2.10"h×1.50"w are placed at a vertical spacing of 3.35" between the center of each LED character block 57*a*–57*n* located on upper and lower display circuit board modules 56 and 56*a*, and additional corresponding display circuit board modules 56 and 56*a*, as illustrated. Vertical and equal distances V1 and V2 are referenced from the upper and lower edges of each display circuit board modules 56 and 56*a*, respectively, where V1 is the distance between the top of an LED character block (such as 57*a*) and the top of the display circuit board module 56, and where V2 is the distance between the bottom of an LED character block (such as 57*d*) and the bottom of the display board module 56. The vertical distances V1 and V2 between LED character blocks 57*d* and 57*e*, plus a predetermined interceding display board module gap, are such that a vertical spacing of 3.35" between the centers of LED character blocks 57*d* and 57*e* will be maintained across juxtaposed upper and lower display circuit board modules 56. In a like and similar fashion, a horizontal spacing of 1.9" between the center of each LED character block located on upper and lower display circuit board modules 56 and 56*a*, and additional corresponding display circuit board modules, as illustrated. Horizontal height H1 and H2 are located at the left and right edges of each display circuit board modules 56 and 56*a*, respectively, where H1 is the distance between the left edge of an LED character block (such as 57*h*) and the left edge of the display circuit board module 56, and where H2 is the distance between the right edge of an LED character block (such as 57*t*) and the right edge of the display board module 56*a*. The horizontal distances H1 and H2 between LED character blocks 57*t* and 57*u*, plus predetermined interceding display board module gap, are such that a horizontal spacing of 1.9" between the center of LED character blocks 57*t* and 57*u* will be maintained across juxtaposed upper and lower display circuit board modules 56*a* and 56. Any number of sectional display systems 10 can be stacked or placed next to each other to provide appropriately constant and equally spaced LED character blocks placed together in a seamless array, that is to say, that the vertical spacing and horizontal spacing, respectively, between corresponding LED character block centers will always be 3.35" and 1.9" as just described.

Figure 9:
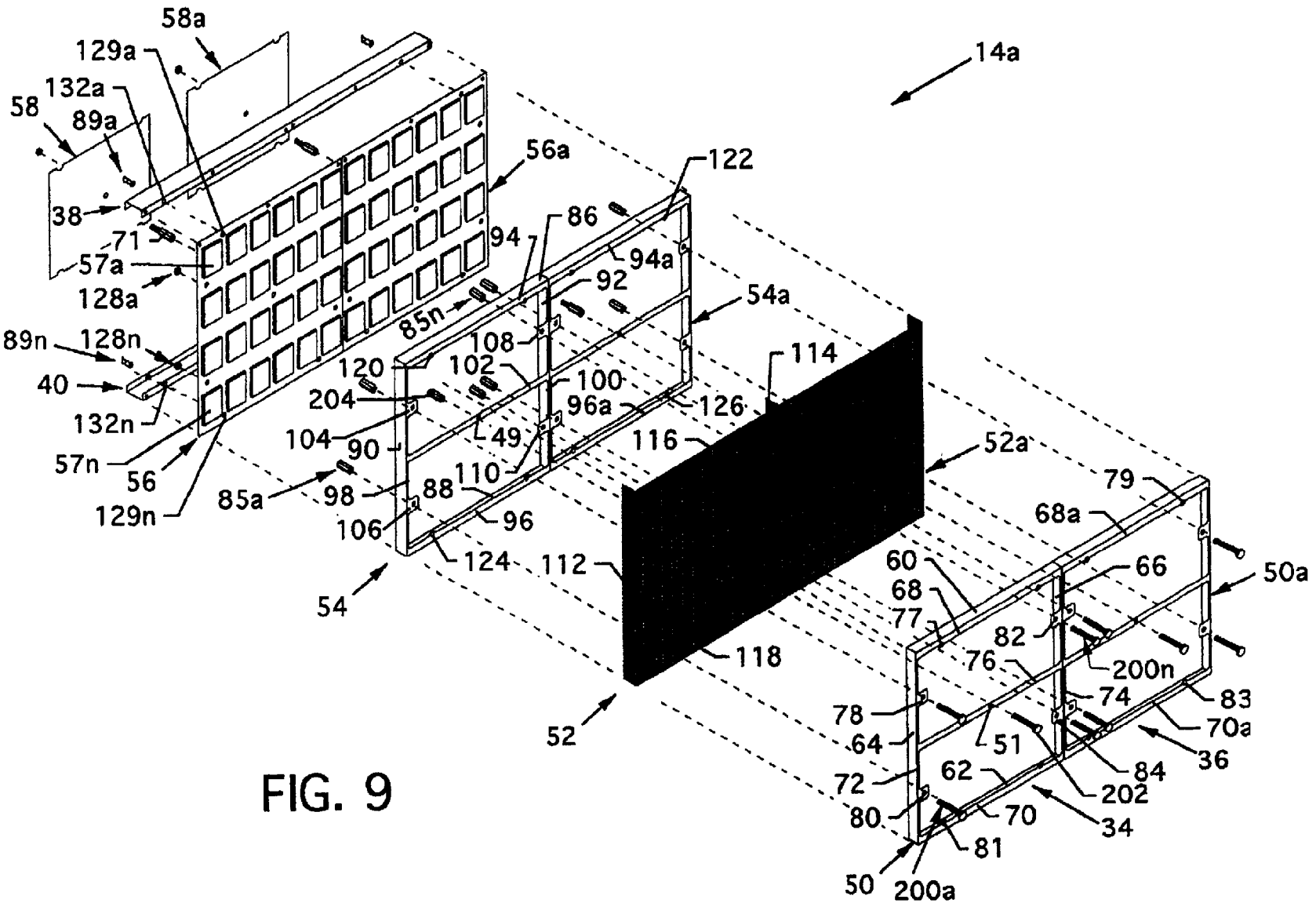
FIG. 9, a first alternative embodiment, illustrates an exploded isometric front view of a representative modular display panel incorporating flush mounted studs.

FIG. 9, a first alternative embodiment, illustrates an exploded view of the modular display panel 14*a*, as described and shown in FIG. 2, but modified to provide for quicker and easier assembly, as well as providing for a more aesthetically pleasing appearance. Such modification includes the replacement of the plurality of machine screws 87*a*–87*n* by studs 200*a*–200*n* which are of self-clinching design which firmly attach to and are flush mounted, and which extend through the body hole of each of the planar tabs 78, 80, 82 and 84 in the outer frame 50. Machine screw 53 is replaced by a stud 202 similar to studs 200*a*–200*n* which firmly attaches to and extends through the hole 51 in the outer frame 50. The studs 200*a*–200*n* extend through the fine mesh screen 52 (and 52*a*), as well as the body holes of each of the planar tabs 104, 106, 108 and 110 and through hole 49 of the inner frame 54, in a manner consistent with that previously described for the machine screws 87*a*–87*n* and machine screw 53. The studs 200*a*–200*n* and stud 202 also threadingly engage spacers 85*a*–85*n* and nuts 128*a*–128*n*. Spacer 69 is replaced by a spacer 204 similar to spacers 85*a*–85*n*. Stud 202 extends through the spacer 204 to act and serve the same function as the replaced (male/female) spacer 69 which threadingly engages the male female spacer 71. Such an arrangement of firmly anchored studs 200*a*–200*n* and stud 202 eliminates the placement of machine screws one at a time and offers multiple engagement of body holes and the like without the cumbersome individual placement of the machine screws and subsequent use of a screwdriver formerly required in the tightening process.

Figure 10:
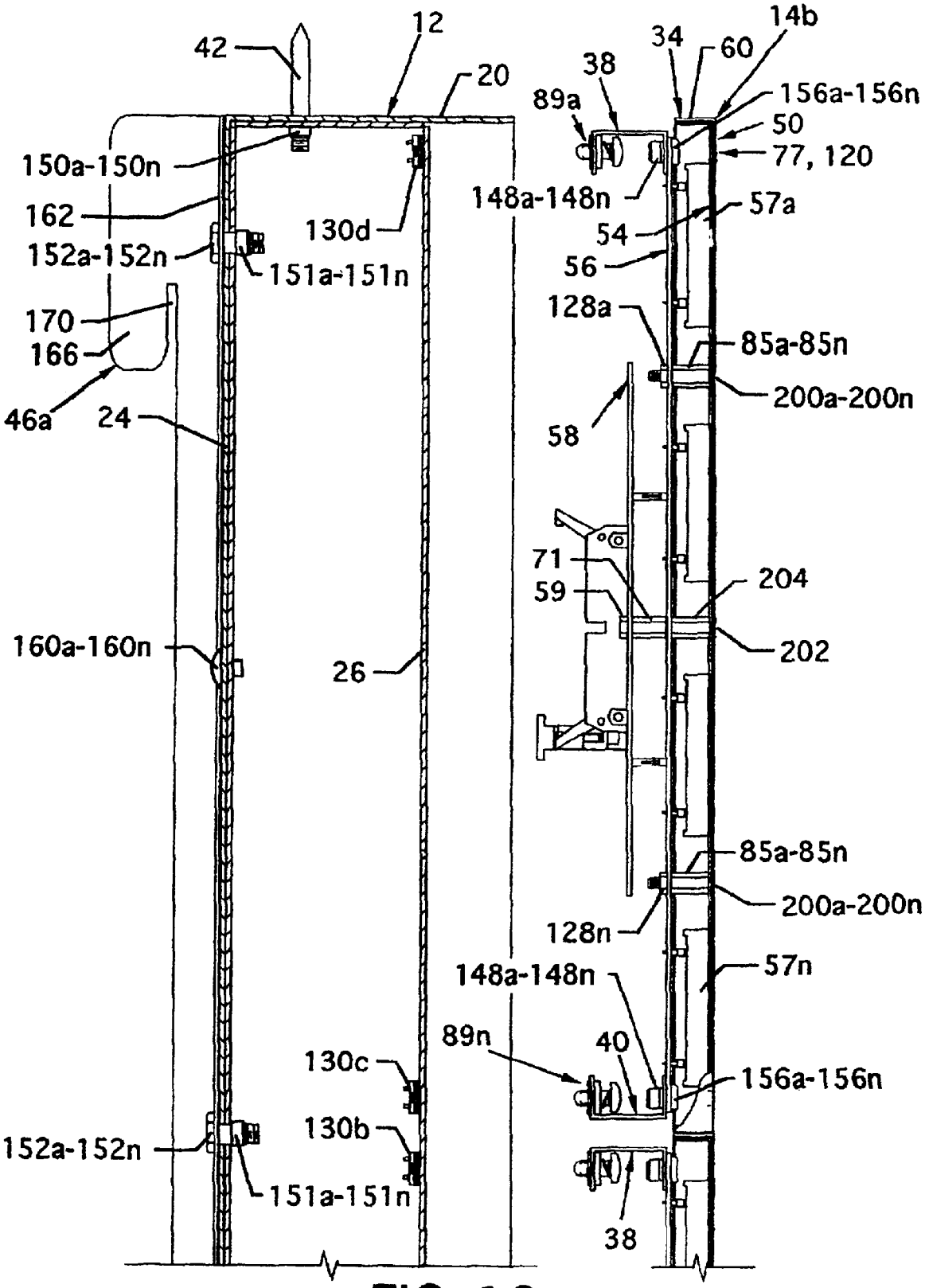
FIG. 10 illustrates a side view of the display panel incorporating flush mounted studs; and, FIG. 11 illustrates the use of flush mounted studs mounted in the outer frame.

FIG. 10 illustrates a side view of the display panel 14*b* similar in construction to the previously described display panel showing studs 200*a*–200*n* and stud 202 firmly engaging the outer frame 50 in flush fashion, as previously described. The studs 200*a*–200*n* and stud 202 are self-clinching and are flush mounted to the outer frame 50. Such flush mounting presents a more streamlined and aesthetically pleasing look, as well as contributing to a low profile of the outer frame 50 and of the sectional display system 10.

Figure 11:
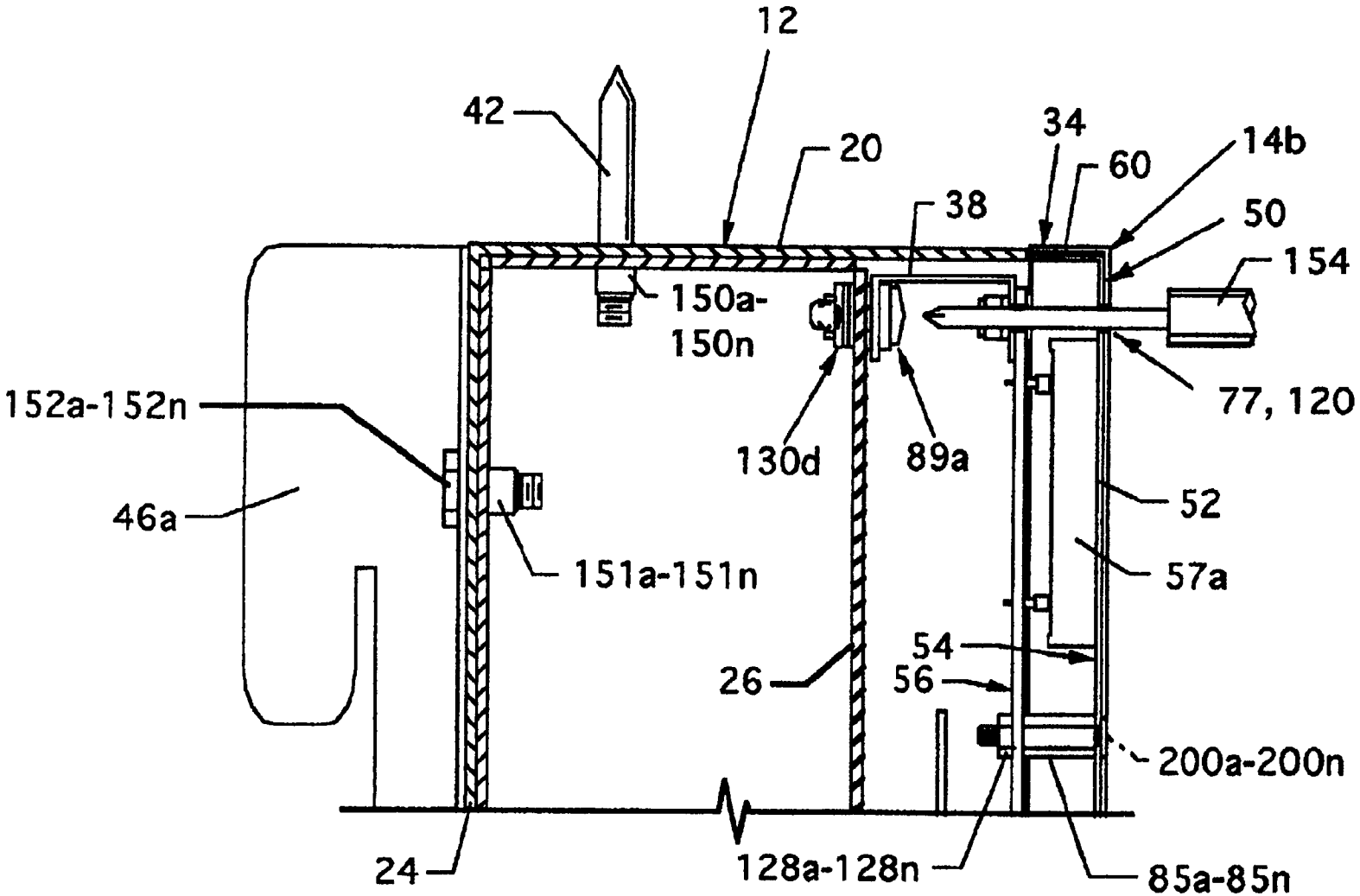

FIG. 11 illustrates the engagement of the upper framework channel 38 to the outer bracket 26 and, in particular, illustrates the studs 200*a*–200*n*, which are self-clinching, being flush mounted in the outer frame 50.

Various modifications can be made to the present invention without departing from the apparent scope hereof.

What is claimed is:

1. A modular display system comprising:

a. an enclosure cabinet having four sides and a back;

b. opposing outer brackets connected between two opposite of said sides, a plurality of inner brackets aligned between said opposing outer brackets and secured to said back of said enclosure cabinet; and, c. a display module connected to one of said opposing outer brackets and to one inner bracket of said plurality of inner brackets, said display module including:

(1) an inner frame;

(2) an outer frame nested over said inner frame where said outer frame is a substantially flat metal surface;

(3) a vision enhancer captured between said inner frame and said outer frame nested over said inner frame;

(4) a display circuit board connected to said inner frame; and, (5) first and second framework channels connected to said inner frame, whereby said first and second framework channels reversibly connect to one of said inner brackets of said plurality of inner brackets.

2. The system of claim 1, wherein said vision enhancer is retained and held in position by said inner and outer frames.

3. The system of claim 1, wherein said vision enhancer is a fine mesh screen.

4. The system of claim 1, wherein said display circuit board includes a plurality of LED display blocks of a size selected from a group consisting of:

a. 1.25"H by 0.90"W;

b. 2.10"H by 1.50"W; and, c. 4.20"H by 3.00"W.

5. The system of claim 4, including at least two brackets with upper and lower tabs and slots which affix to the back of said display cabinet.

6. The system of claim 5, further including two Z-bars, said Z-bars adapted for mounting on a substantially vertical surface, whereby said upper and lower tabs and slots facilitate vertical mounting of the system by engaging said two Z-bars.

7. An electronic sectional display system comprising:

a. a display cabinet;

b. a plurality of modular display panel mounting brackets secured to said cabinet;

c. a plurality of female fastener receptacles affixed to said display panel mounting brackets;

d. a plurality of modular display panels, each said panel including:

(1) a circuit board having a plurality of character display blocks;

(2) a frame secured to said circuit board said frame including an inner frame, an outer frame nested over said inner frame, said outer frame being a substantially flat metal surface, and a viewing enhancer positioned between and retained by said inner and said outer frames;

(3) a plurality of frame mounting brackets affixed to said frame; and, (4) a plurality of male fastener elements positioned on said frame mounting brackets for engagement with said female fastener receptacles on said display panel mounting brackets; and, e. fastener element access holes positioned in said frame for accommodation of a tool for engaging and disengaging said male fastener elements from said female fastener receptacles, whereby said modular display panels may be dismounted from said cabinet from the front of said display cabinet.

8. The electronic display system according to claim 7, wherein said character display blocks are arranged in rows and columns.

9. The electronic display system according to claim 7, wherein said modular display panel mounting brackets are perpendicularly oriented with respect to said frame mounting brackets.

10. The electronic display system according to claim 9, wherein said modular display panel mounting brackets are vertically oriented and said frame mounting brackets are horizontally oriented.

11. The electronic display system according to claim 7, wherein:

a. said inner and outer frames have abutting portions, at right angles to said circuit board, on opposite ends of said frames; and, b. said viewing enhancer has retention tabs which are positioned between said right angled abutting portions to be clamped and retained thereby.

12. The electronic display system according to claim 11, wherein said fastener element access holes are positioned on said inner frame, said outer frame and said circuit board.

13. The electronic display system according to claim 12, wherein said viewing enhancer includes a fine mesh screen.

14. The electronic display system according to claim 13, wherein said female fastener receptacles and said male fastener elements comprise one-quarter turn screw fasteners.

15. The electronic display system according to claim 13, wherein said male fastener elements include a captive screw.

16. An electronic sectional display system comprising:

a. a display cabinet having a front;

b. a plurality of vertically oriented modular display panel mounting brackets secured to said display cabinet;

c. a plurality of female fastener receptacles affixed to said plurality of vertically oriented mounting brackets;

d. a plurality of modular display panels, each panel of the plurality of panels including:

(1) a circuit board having a plurality of character display blocks arranged in rows;

(2) an inner frame;

(3) an outer frame adapted to fit over said inner frame, said outer frame being a substantially flat metal surface;

(4) a viewing enhancer screen positioned between and retained by said inner and outer frames;

(5) a plurality of horizontally oriented mounting brackets affixed to said circuit board, said inner frame and said outer frame; and, (6) a plurality of male fastener elements positioned on said plurality of horizontally oriented mounting brackets for engagement with said plurality of female fastener receptacles on said plurality of vertically oriented mounting brackets; and, e. fastener element access holes positioned in said outer frame, said inner frame, said viewing enhancer screen, and said circuit board for engaging and disengaging said plurality of male fastener elements, whereby said plurality of modular display panels may be dismounted from said display cabinet from the front of said display cabinet.

17. An electronic sectional display system comprising:

a. a display cabinet having a front;

b. a plurality of vertically oriented modular display panel mounting brackets secured to opposite sides of said display cabinet;

c. a plurality of female fastener receptacles affixed to said plurality of vertically oriented modular display mounting brackets;

d. a plurality of modular display panels, each panel of said plurality including:

(1) a circuit board having a plurality of character display blocks arranged in rows and columns;

(2) a frame member including an inner frame and an outer frame, the outer frame being a substantially flat metal surface;

(3) a plurality of horizontally oriented mounting brackets affixed to said frame member; and, (4) a plurality of male fastener elements positioned on said horizontally oriented mounting brackets for engagement with said female fastener receptacles on said plurality of vertically oriented modular display panel mounting brackets; and, e. fastener element access holes positioned in said frame member for accommodations of a tool for engaging and disengaging each said male fastener element, whereby said modular display panels may be dismounted from said display cabinet from the front of said display cabinet.

18. The electronic sectional display system of claim 17, wherein the frame includes a vision enhancer between the outer and inner frames.

19. The electronic sectional display of claim 18, wherein the outer frame further includes a plurality of studs, each stud of the plurality of studs extending through the vision enhancer and the inner frame.

20. The electronic sectional display of claim 19, wherein each stud of the plurality of studs is firmly attached to the outer frame.

21. The electronic sectional display of claim 19, wherein each stud of the plurality of studs is flush mounted to the outer frame.

22. The electronic sectional display of claim 19, wherein each stud of the plurality of studs is self-clinching.

23. A display system comprising:

a. an enclosure having four sides and a back;

b. a plurality of brackets within the enclosure;

c. a plurality of display modules reversibly mounted to the plurality of brackets of the enclosure, each of the display modules including in order from front to rear:

(1) an outer frame where said outer frame is a substantially flat metal surface;

(2) a vision enhancer;

(3) an inner frame nested to said outer frame and capturing said vision enhancer there between, (4) a display circuit board connected to said inner frame; and, (5) first and second framework channels connected to said inner frame, whereby said first and second framework channels reversibly connect to the plurality of brackets.

24. The display system of claim 23, wherein the outer frame includes a flush mounted stud extending rearward through the vision enhancer and the inner frame.

25. The display system of claim 24, wherein the stud is self-clinching to the outer frame.

26. The display system of claim 23, wherein said vision enhancer is a fine mesh screen.

27. The system of claim 23, wherein said display circuit board includes a plurality of LED display blocks of a size selected from a group consisting of:

a. 1.25"H by 0.90"W;

b. 2.10"H by 1.50"W; and, c. 4.20"H by 3.00"W.

28. The system of claim 27, wherein the LED display blocks are 2.10"H by 1.50"W and have a vertical spacing of 3.35" between LEDs on a single display circuit board.

29. The system of claim 27, wherein the LED display blocks are 2.10"H by 1.50"W and have a vertical spacing of 3.35" between LEDs of juxtaposed upper and lower display circuit board modules.

30. The system of claim 27, wherein the LED display blocks are 2.10"H by 1.50"W and have a horizontal spacing of 1.9" between LEDs on a single display circuit board.

31. The system of claim 27, wherein the LED display blocks are 2.10"H by 1.50"W and have a horizontal spacing of 1.9" between LEDs of juxtaposed display circuit board modules.

32. The system of claim 23, including a plurality of brackets with upper and lower tabs and slots which affix to the back of said enclosure.

33. The system of claim 23, further including two Z-bars, said Z-bars adapted for mounting on a substantially vertical surface.

34. The system of claim 23, wherein the display circuit boards include LED display blocks, each of the LED blocks having identical height and identical width and the system maintains a constant vertical spacing between LEDs of vertically juxtaposed display circuit board modules and LEDs on each display board and the system maintains a constant horizontal spacing between LEDs of horizontally juxtaposed display circuit boards and LEDs on each circuit board.

* * * * *